US008745914B2

(12) United States Patent
Schmidt

(10) Patent No.: US 8,745,914 B2
(45) Date of Patent: Jun. 10, 2014

(54) TELESCOPIC SIGHT RING MOUNTS ALIGNMENT TOOL

(71) Applicant: Gerald Lee Schmidt, Bozeman, MT (US)

(72) Inventor: Gerald Lee Schmidt, Bozeman, MT (US)

( * ) Notice: Subject to any disclaimer, the term of this patent is extended or adjusted under 35 U.S.C. 154(b) by 0 days.

(21) Appl. No.: 13/916,537

(22) Filed: Jun. 12, 2013

(65) Prior Publication Data

US 2013/0276318 A1 Oct. 24, 2013

Related U.S. Application Data

(63) Continuation-in-part of application No. 13/355,811, filed on Jan. 23, 2012, now abandoned.

(60) Provisional application No. 61/464,396, filed on Mar. 3, 2011.

(51) Int. Cl.
*F41G 1/54* (2006.01)

(52) U.S. Cl.
CPC ..... *F41G 1/545* (2013.01)
USPC ..... 42/125; 42/106

(58) Field of Classification Search
CPC ..... F41G 1/54; F41G 1/545; F41G 1/44; F41G 11/00; F41G 11/001; F41G 3/32; F41G 3/323; F41G 3/326; G01B 5/25
USPC ..... 89/41.17; 42/119, 90, 106, 120, 124, 42/125, 126, 135, 137, 171
See application file for complete search history.

(56) References Cited

U.S. PATENT DOCUMENTS

| | | | | |
|---|---|---|---|---|
| 623,571 | A | | 4/1899 | Shipe |
| 2,484,801 | A | | 10/1949 | Anderson |
| 2,517,268 | A | * | 8/1950 | Wilson ..... 33/533 |
| 2,638,676 | A | | 5/1953 | Callahan |
| 3,711,955 | A | | 1/1973 | Holt |
| 4,233,748 | A | | 11/1980 | Ford et al. |
| 4,455,757 | A | | 6/1984 | Schwartz |
| 4,569,145 | A | | 2/1986 | Ruger et al. |
| 4,790,079 | A | | 12/1988 | Meyers |
| 5,022,176 | A | | 6/1991 | Frigon et al. |
| 5,233,124 | A | | 8/1993 | Peterson |
| 5,630,292 | A | | 5/1997 | Heinz et al. |
| 5,779,294 | A | | 7/1998 | Magri |

(Continued)

*Primary Examiner* — Bret Hayes
*Assistant Examiner* — Joshua Freeman
(74) *Attorney, Agent, or Firm* — Richard C Litman

(57) ABSTRACT

The telescopic sight ring mounts alignment tool is an elongate, rigid, unitary, monolithic, solid bar having an outside diameter fitting closely within the mounting rings for a telescopic sight on a firearm. The tool may be used to secure dovetail mount-type scope rings to the firearm by securing the tool within each ring separately, and torqueing the tool to secure each ring in sequence. Alignment of rings of any mounting configuration with the barrel bore is checked by securing the tool within both rings and checking alignment of the beveled conical rear and the tapered front tip of the tool, respectively, with the receiver tang and the barrel of the firearm. The tool may be manufactured with an outside diameter dimensioned and configured to fit different inside diameter rings. Alternatively, different diameter sleeves may be provided to adapt a single tool for use with different inside diameter rings.

9 Claims, 9 Drawing Sheets

(56) References Cited

U.S. PATENT DOCUMENTS

| | | | |
|---|---|---|---|
| 5,813,131 | A | 9/1998 | Werre |
| 6,499,247 | B1 | 12/2002 | Peterson |
| 7,052,059 | B2 | 5/2006 | Farid et al. |
| 7,313,885 | B1 | 1/2008 | Looney |
| D662,565 | S | 6/2012 | Burtt |
| 2006/0033348 | A1 | 2/2006 | Farid et al. |
| 2007/0169392 | A1 | 7/2007 | Davis |
| 2012/0324776 | A1 | 12/2012 | Hepler |

* cited by examiner

TELESCOPIC SIGHT RING MOUNTS ALIGNMENT TOOL

CROSS REFERENCE TO RELATED PATENT APPLICATIONS

This application is a continuation-in-part of U.S. patent application Ser. No. 13/355,811, filed on Jan. 23, 2012, which claimed the benefit of U.S. Provisional Patent Application Ser. No. 61/464,396 filed on Mar. 3, 2011.

BACKGROUND OF THE INVENTION

1. Field of the Invention

The present invention relates generally to tools and devices used in aligning various components to one another, and particularly to a telescopic sight ring mounts alignment tool for aligning the front and rear clamping rings of a telescopic sight with one another and with the bore of the barrel of the firearm to which they are affixed.

2. Description of the Related Art

The present invention relates to an alignment tool used to install and align the ring mounts, which hold a telescopic sight such that they align with the centerline of a firearm barrel before the telescopic sight is mounted to the firearm.

When using a firearm with a telescopic sight, it is important that the telescopic sight be aligned with the centerline of the barrel corresponding to the bore of the barrel to enable a shooter to place a projectile at a selected point in the distance, such as when shooting at an animal or target.

Tools are known for aligning the rear and front ring mounts which hold a telescopic sight onto a rifle, such as U.S. Pat. No. 5,813,131, which discloses a pair of telescopic sight ring mount aligning bars. Each bar has a planar circular end bounded by a circular peripheral edge. Misalignment of the telescopic sight mounting rings is determined by a misalignment of the peripheral edges relative to one another and by a non-parallelism between the two inner ends. U.S. Pat. No. 7,313,885 describes another alignment device for telescopic sight ring mounts, wherein two rods are mounted in the telescopic sight rings and alignment is achieved by aligning the female end of one rod to the male end of another rod when the two rods are slidably engaged. Both of these inventions require two rods, which must be aligned to achieve alignment of the telescopic sight rings. Neither of these inventions provides a mechanism for aligning the telescopic sight rings with the centerline of the barrel.

The present invention is a significant improvement over these known devices by providing a one-piece rod that has a tapered forward tip for aligning the ring mounts. Accurate alignment of the ring mounts is checked by determining whether the tapered forward tip is aligned with the centerline of the barrel. The present invention is easy to use and provides a visual indication whether the front and rear ring mounts are aligned with the longitudinal centerline of the barrel corresponding to the bore of the barrel.

Thus, a telescopic sight ring mounts alignment tool solving the aforementioned problems is desired.

SUMMARY OF THE INVENTION

A telescopic sight ring mounts alignment tool according to the present invention includes an elongate cylindrical rod having a tapered front tip. When the elongate rod is mounted in the front and rear telescopic sight mounting rings, misalignment of the mounting rings may be checked by visually determining whether the tapered front tip is aligned with the longitudinal centerline of the barrel. Further, the present invention may be used to align and install a variety of front and rear mounting rings before mounting a telescopic sight to a firearm. The present invention is quick to use, has only one moving part and accurately checks whether the front and rear telescopic sight mounting rings are aligned with the centerline of the barrel.

Additional embodiments provide for the alignment of various scope rings having different inside diameters to fit various telescopic sights of different outside diameters. In one embodiment, larger diameter portions are formed integrally with the bar or shaft to fit closely within telescopic sight mounting rings having relatively larger inside diameters, e.g., 30 millimeters or 1.181 inches. In another embodiment, the portion of the bar or shaft that passes through the rings is machined or otherwise formed to have a diameter equal to that of the smaller inside diameters of some scope mounting rings, e.g., one inch or 25.4 millimeters, and sleeves having a larger external diameter, e.g., 30 millimeters, are provided to adapt the tool to such larger internal diameter scope mounting rings. Still another embodiment provides a shaft of relatively small diameter and sleeves having internal diameters matching the external diameter of the shaft and various outside diameters to match the inside diameters of different scope mounting rings. Each of these embodiments includes a pointed alignment tip at the forward end thereof to allow the user to align the tool precisely with the longitudinal axis of the barrel of the firearm.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
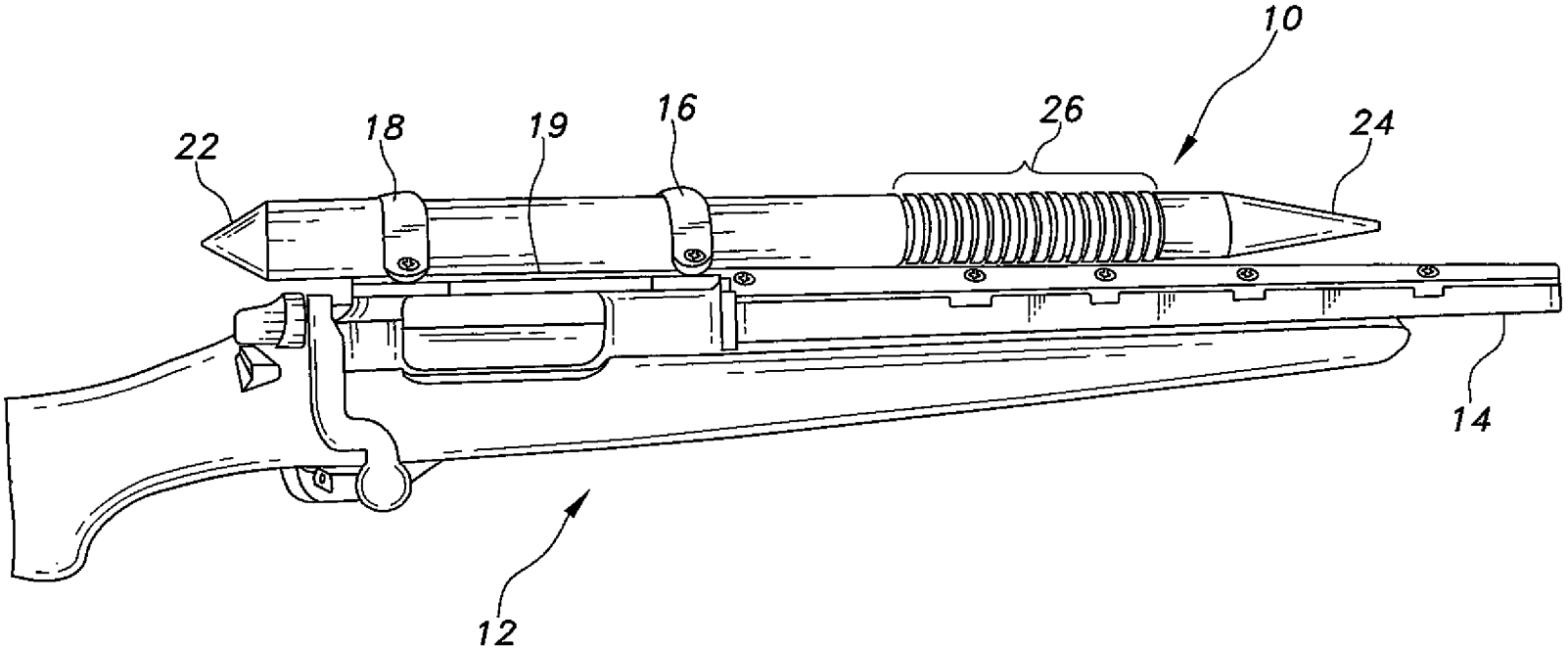
FIG. 1 is a perspective view of a telescopic sight ring mounts alignment tool according to the present invention, shown mounted on a rifle.
Figure 2:
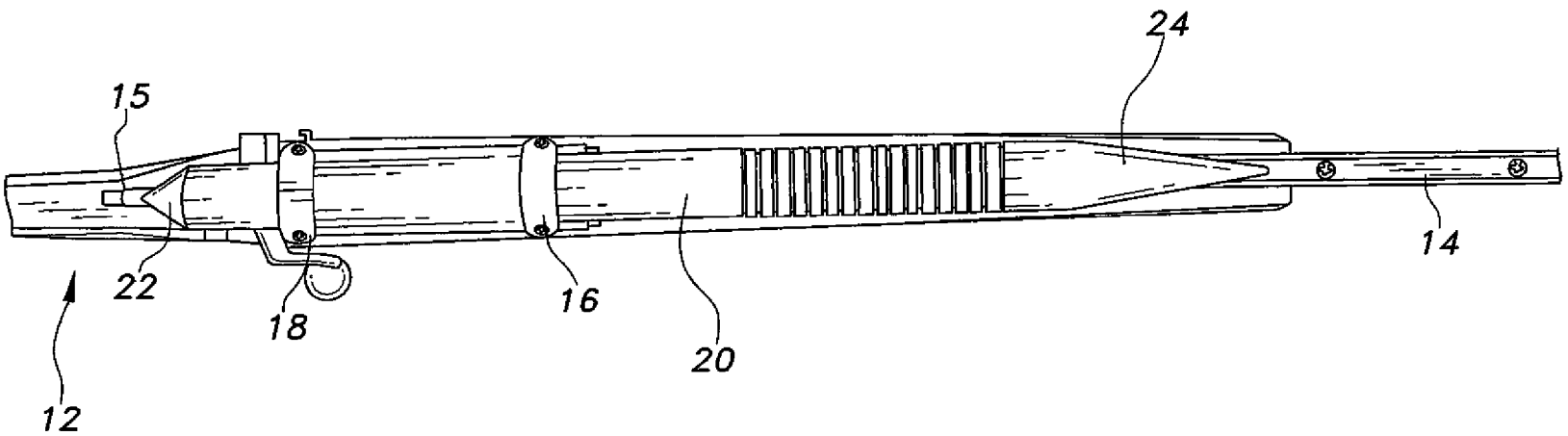
FIG. 2 is an environmental top view of the tool shown in FIG. 1.
Figure 3:
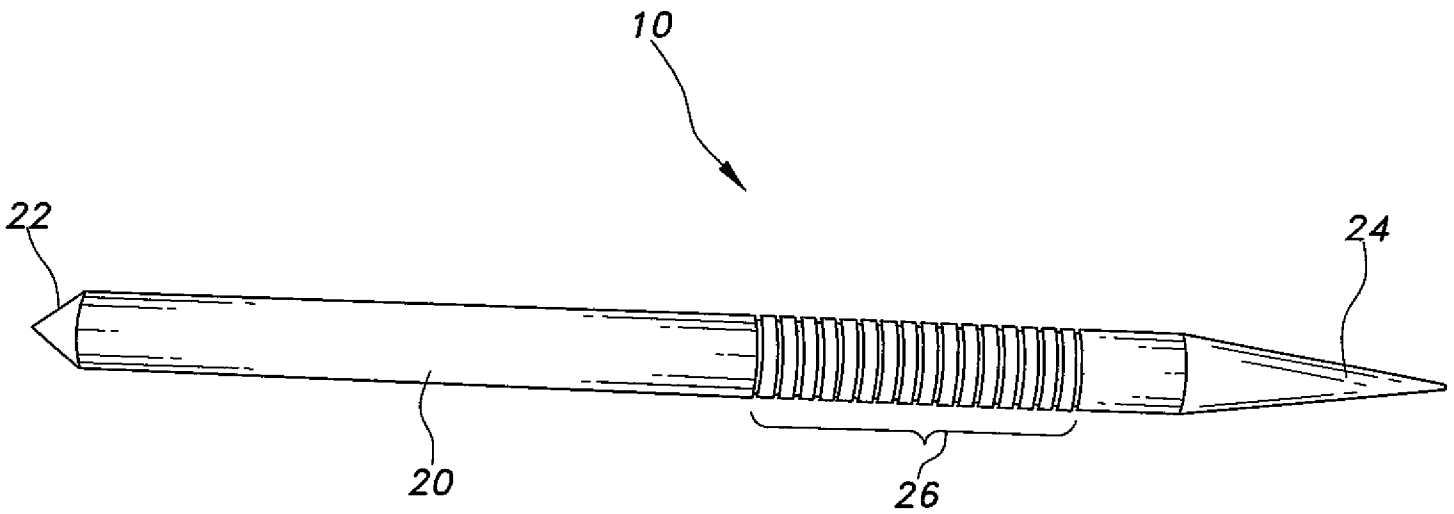
FIG. 3 is a perspective view of the tool of FIG. 1.

A telescopic sight ring mounts alignment tool 10 is shown in FIGS. 1-3 as used with a rifle 12. As shown in FIGS. 1 and 2, the alignment tool 10 is used with a rifle 12 having a barrel 14 and a front telescopic sight mounting ring 16 and a rear telescopic sight mounting ring 18. The front ring 16 and rear ring 18 are mounted to a rifle on a base 19 in a conventional manner. It is understood that the alignment tool 10 may be used on other firearms such as a shotgun or handgun where a telescopic sight is mounted with mounting rings.

As shown in FIG. 3, the alignment tool 10 is constructed of an elongate cylindrical rod 20 having a beveled rear end 22 and a tapered front tip 24. In a preferred embodiment the front tip 24 has a blunt forward end so as to avoid injury. The rod 20 also includes either a knurled or veined surface 26 for easily grasping the rod 20 during the ring installation and alignment process.

Figure 4:
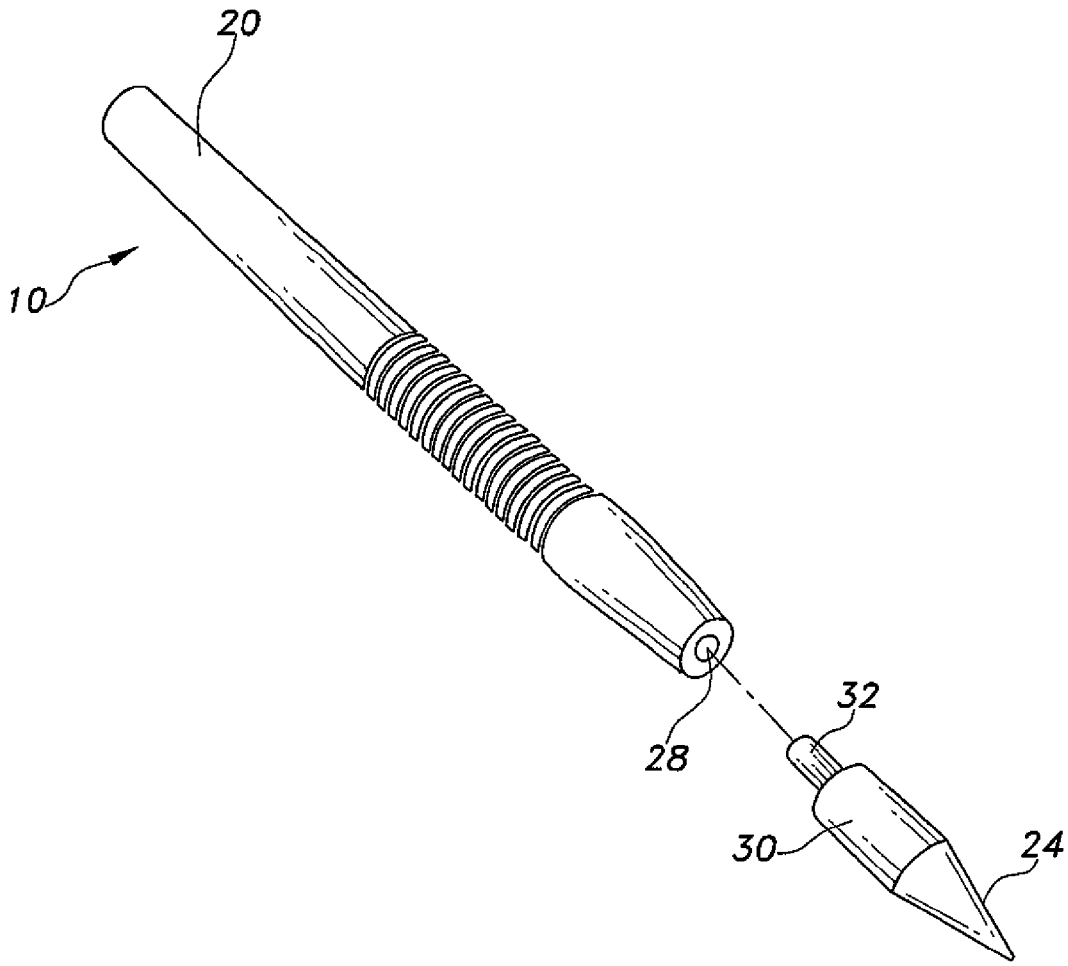
FIG. 4 is a perspective view of a second embodiment of a telescopic sight ring mounts alignment tool according to the present invention.

A second embodiment of the present invention is shown in FIG. 4. In this embodiment, a replaceable tip 30 is provided. The rod 20 is provided with a threaded axial bore 28 at the front end thereof. The replaceable tip 30 has a threaded shaft 32 formed integrally with the tip 30. The shaft 32 is sized to be threadably received by the axial bore 28.

The embodiments described herein can be used to check the alignment of the front and rear ring mounts 16 and 18. They can also be used for installing and/or aligning the front and rear ring mounts 16 and 18 with the centerline of the barrel 14 as described below.

Either of the two above embodiments may be used in a similar manner for installing and aligning the front ring mount 16 and rear ring mount 18 with the centerline of the barrel 14. The alignment tool 10 can be used with either a standard rifle telescopic sight mount having a rotary dovetail front ring 16 and a windage adjustable rear ring 18, or with a dual dovetail mount having a rotary dovetail front ring 16 and a rotary dovetail rear ring 18.

When using the alignment tool 10 with standard mounts having a rotary dovetail front ring and a windage adjustable rear ring 18, the front ring 16 and the rear ring 18 are first separated from the base 19. The front ring 16 and rear ring 18 are conventionally constructed and have two halves joined together with ring screws. The ring screws of ring 16 are loosened and the beveled end 22 of the rod 20 is then inserted through the front ring 16 and slid through the front ring 16 about 1 or 2 inches from the beveled end 22. The ring screws are now tightened. The front ring 16 is then mounted to the base 19 in a conventional manner. The rod 20 is then grasped with the knurled surface 26 and rotated until the tip 24 is aligned with the centerline of the barrel 14 as shown in FIG. 2. After tip 24 is aligned with the centerline of barrel 14, the ring screws of the front ring 16 are then loosened and the rod 20 slid rearwardly.

The bottom half of rear ring 18 is now placed onto base 19 between the windage screws provided in base 19. The rod 20 is now extended further rearward to rest on top of the bottom half of the rear ring 18. The top half of the rear ring 18 is now joined to its bottom and the ring screws tightened, securing rear ring 18 to the rod 20. With the alignment tool 10 now in position, the base 19 windage screws are used to move the rear ring right or left, as needed, to position the tip 24 in alignment with the centerline of barrel 14. The tip of the beveled end 22 is then checked to confirm that it is centered on a receiver tang 15 provided on the rifle 12. With the tip 24 aligned with the centerline of the barrel 14, and the beveled end 22 centered on the receiver tang 15, the windage screws are then fully tightened to their final position, and the alignment of tip 24 on barrel 14 is re-checked. If necessary, adjustments to the rear ring are made.

The rings 16 and 18 are now positioned perfectly so that the telescopic sight to be mounted on the rifle is properly aligned with the centerline of the barrel 14. The top halves of the rings 16 and 18 may now be removed and the rod 20 removed from the rings. A rifle telescopic sight may then be placed in the rings and the top halves remounted to the bottom halves to hold the rifle telescopic sight in place.

Either the first or second embodiment of the present invention may be used to align dual rotary dovetail rings where the rear ring 18 and front ring 16 are identical. Taking the rear ring 18 first, the ring screws are loosened and the beveled end 22 of the rod 20 is then inserted through the rear ring 18 about 1 or 2 inches from the beveled end 22. The ring screws are now tightened. The rear ring 18 is then mounted to base 19 in a conventional manner by grasping the rod 20 at the knurled surface 26 and rotating the rod 20 until the tip 24 is aligned with the centerline of the barrel 14. The ring screws holding the top half of the rear ring 18 to the bottom half 18 are loosened and the rod 20 is removed. This procedure is repeated with respect to the front ring 16 aligning the tip 24 with the centerline of the barrel 14. The ring screws on the front ring 16 are then loosened and the rod 20 is now slid rearwardly through the rear ring 18. The ring screws are then tightened on both the front ring 16 and rear ring 18. The alignment tool 10 is now in position to check for proper alignment. The tip 24 of rod 20 is now checked with the barrel 14, making certain the tip 24 is in alignment with the centerline of the barrel 14. The tip of the beveled end 22 is then checked to confirm that it is centered on a receiver tang 15 provided on the rifle 12. If well centered, the ring screws, top ring halves of front ring 16 and rear ring 18, along with the bar 20 are now removed, and a telescopic sight is then mounted in the front ring 16 and rear ring 18 as desired, with the telescopic sight now properly aligned with the centerline of the barrel 14.

Figure 5:
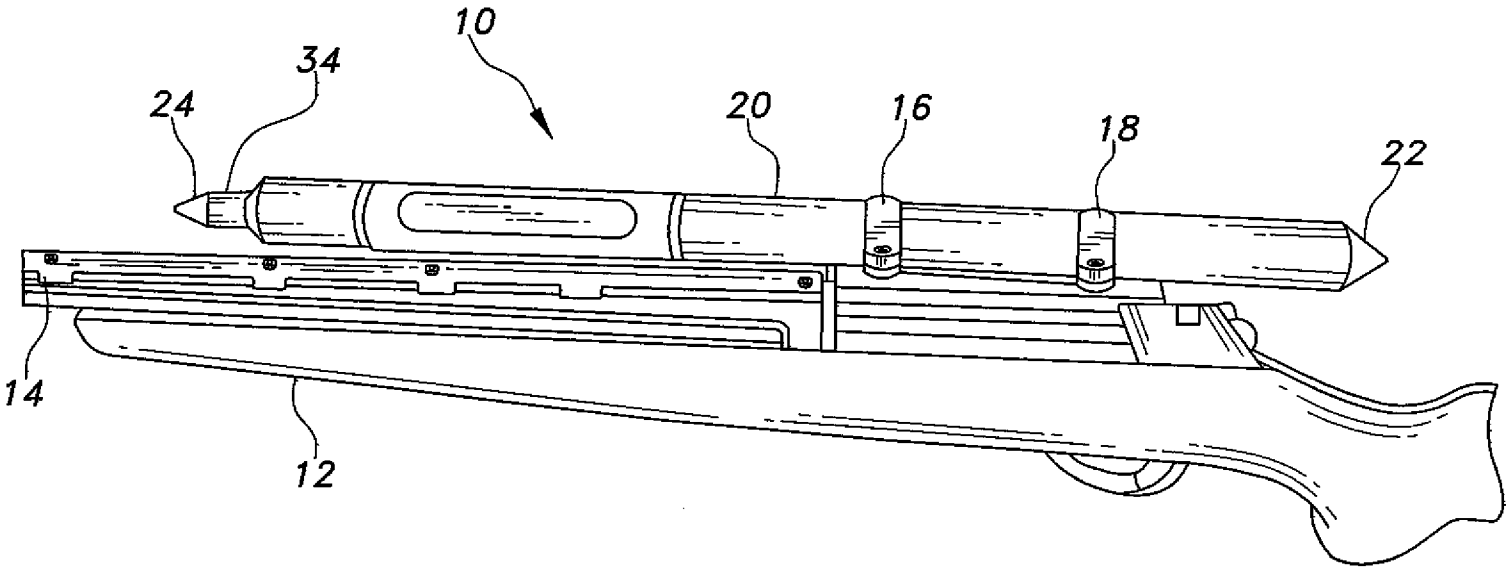
FIG. 5 is a partial environmental elevational view of a third embodiment of a telescopic sight ring mounts alignment tool according to the present invention, shown mounted on a rifle.
Figure 6:
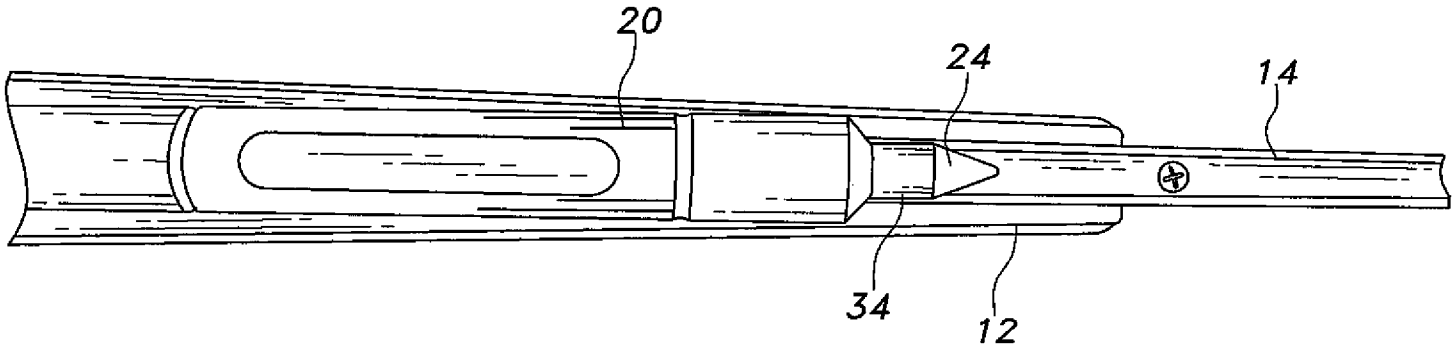
FIG. 6 is a partial environmental top view of the tool of FIG. 5.

A third embodiment of the present invention is shown in FIGS. 5 and 6. This embodiment is similar to the first embodiment and similar element numbers are used to describe corresponding elements. The one difference of the third embodiment over the first embodiment is that there is provided an extension shaft 34 sized to be slightly larger or slightly less than the diameter of the barrel 14. This extension shaft 34 is used as a final check of the alignment of the centerline alignment of the rifle telescopic sight ring mounts alignment tool 10 with the centerline of the barrel 14 by checking the parallelism between the longitudinal edges of the extension shaft 34 and the longitudinal sides of the barrel 14. The operation of the third embodiment used in adjusting the front and rear mounting rings, is the same as with the first embodiment with the additional alignment checking feature.

The first, second, and third embodiments can be used with standard rotary dovetail front ring mount and windage adjustable rear mount and also with a dual dovetail rotary ring mount, where both the front and rear ring mounts are rotary dovetail ring mounts.

The first, second and third embodiments can also be used with cross-slot style windage adjustable front and rear rings by placing the rod 20 in both rings and adjusting the windage screws of the front and rear rings together, so that both rings are aligned with the centerline of the rifle barrel.

The first, second and third embodiments can also be used to check the alignment of non-adjustable proprietary factory mounted rings by placing the rod 20 in the bottom halves of both front and rear rings and checking the alignment with the centerline of the rifle barrel.

The first, second and third embodiments can also be used to check the alignment of non-adjustable removable cross-slot style rings by placing the rod 20 in the bottom halves of both front and rear rings and checking the alignment with the centerline of the rifle barrel.

In all instances of using the alignment tool 10, the tip of the beveled end 22 may be checked to confirm that it is centered on a receiver tang 15 provided on the rifle 12. This provides an additional point of reference in the final stage of the alignment procedure.

Figure 7:
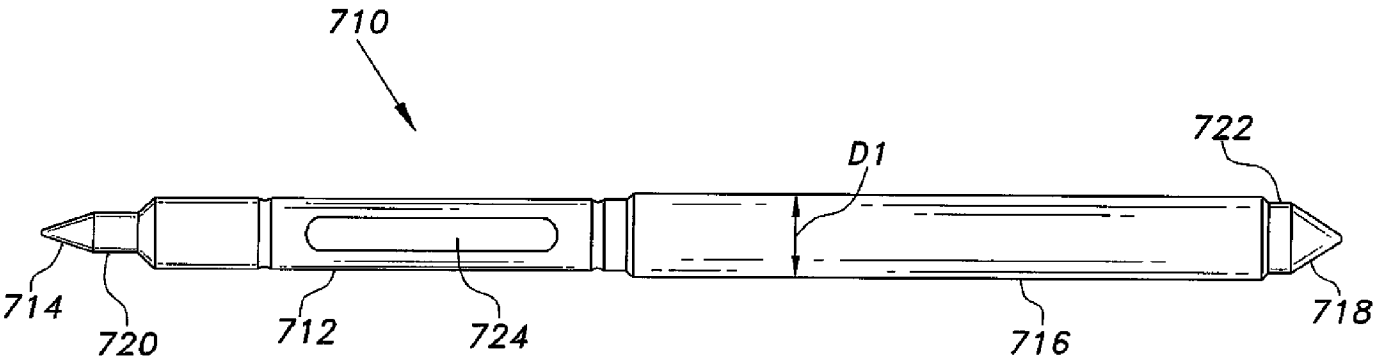
FIG. 7 is a left side elevation view of a fourth embodiment of a telescopic sight ring mounts alignment tool according to the present invention.

FIG. 7 of the drawings illustrates a side elevation view of a fourth embodiment of the telescopic sight ring mounts alignment tool, designated as tool 710. As in the case of the embodiments of FIGS. 1 through 6, the tool 710 of FIG. 7 is formed of a single, straight, unitary length of highly rigid material, such as metal bar stock or the like, e.g., tool steel, corrosion-resistant steel (i.e., "stainless" steel), or even brass or aluminum, to preclude any significant bending of the tool while in use. The tool 710, and all other embodiments, is formed from a solid monolithic bar or rod that is devoid of interior hollows to make it completely rigid, for all practical purposes.

The tool 710 of FIG. 7 includes a forward portion 712 having a forward tip 714, and an opposite rearward sight ring alignment portion 716 having a rearward tip 718. The forward and rearward tips 714 and 718 are conically tapered and axially concentric with the remainder of the tool 710. The forward tip 714 serves as a firearm barrel alignment indicator and the rearward tip 718 provides for alignment of the tool with the receiver tang or other structure of the firearm in aligning the telescopic sight rings on a firearm, as described further above for the first three embodiments of FIGS. 1 through 6. A smaller diameter cylindrical portion 720 may be provided between the forward end of the constant diameter, cylindrical forward portion 712 and the conically tapered tip 714 to provide greater resolution when aligning the forward end of the tool with the firearm barrel. Similarly, a smaller diameter cylindrical portion 722 may extend between the constant diameter, cylindrical sight ring alignment portion 716 and the rearward receiver tang alignment tip 718.

Figure 9:
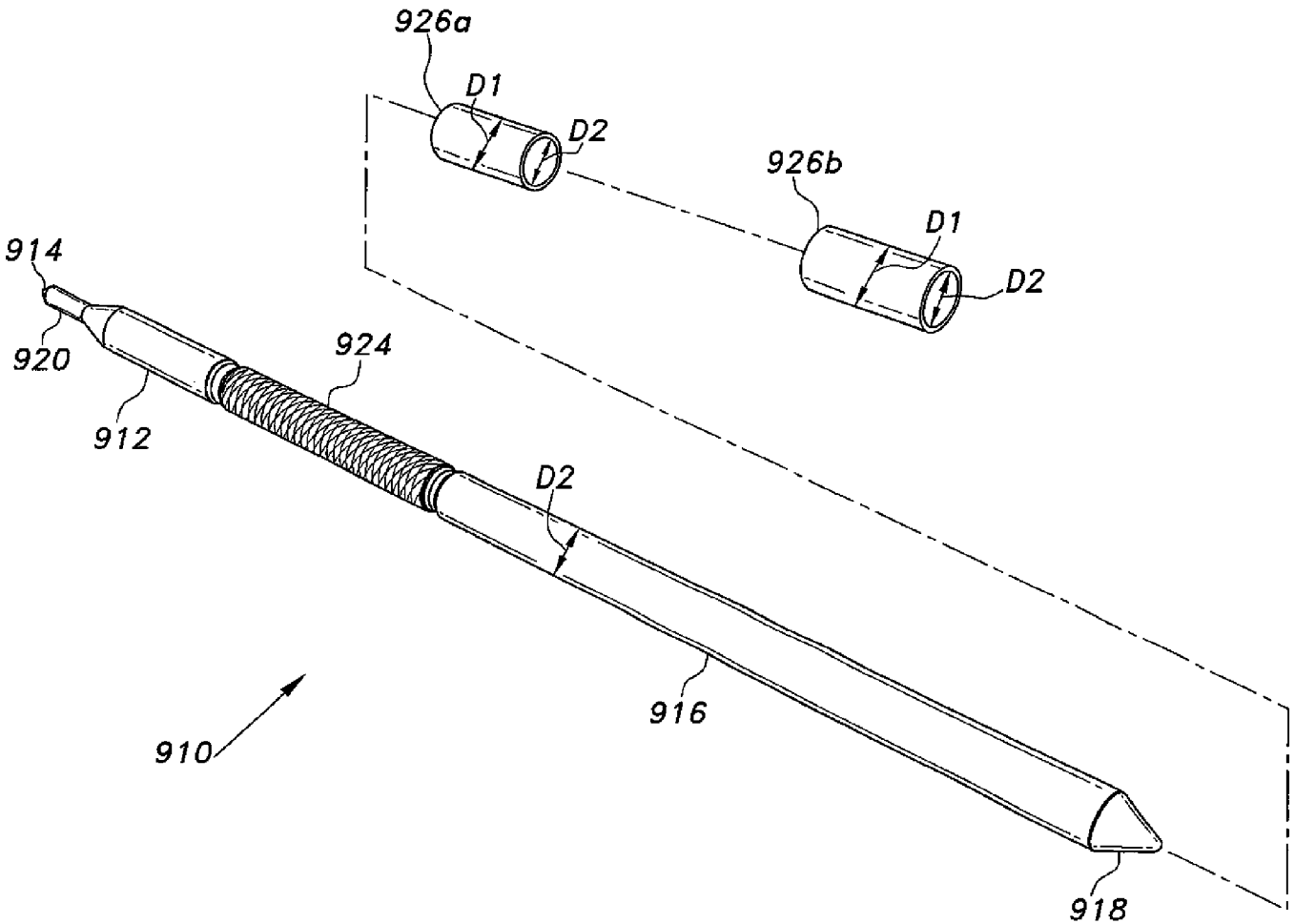
FIG. 9 is a perspective view of a sixth embodiment of a telescopic sight ring mounts alignment tool according to the present invention, wherein front and rear adapter sleeves are provided for different size scope rings.
Figure 10:
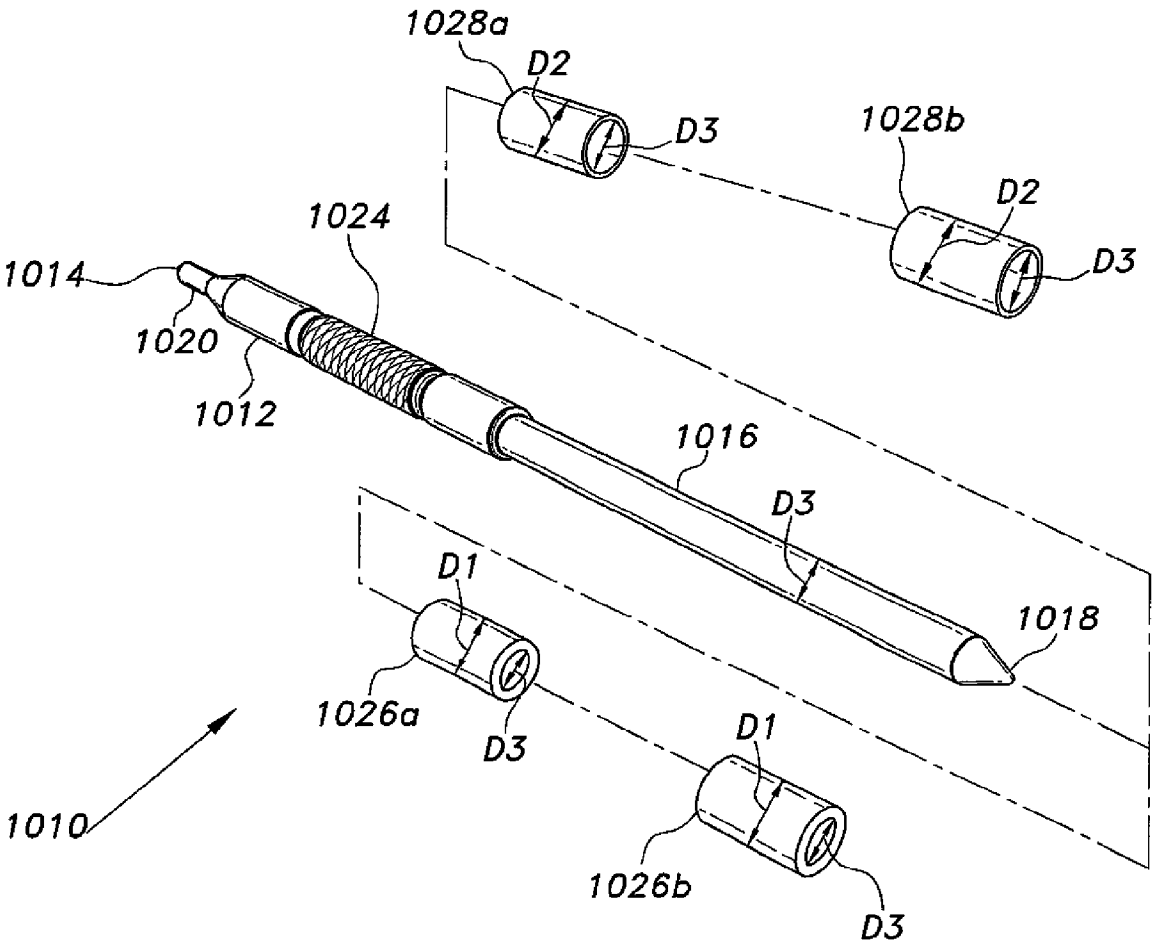
FIG. 10 is a perspective view of a seventh embodiment of the telescopic sight ring mounts alignment tool according to the present invention, wherein front and rear adapter sleeves of different outer diameters are provided for different size scope rings.

The forward portion 712 has an arbitrary diameter, e.g., one inch. The forward portion 712 is used primarily for handling the tool 710 and for the extension of the forward firearm barrel alignment indicator tip 714, and does not need to fit closely with any other components or mechanisms. The forward portion 712 may include a textured gripping surface disposed thereover, generally as shown in the embodiments of FIGS. 9 and 10, or the circumferentially ribbed surface 26 of the first two embodiments illustrated in FIGS. 1 through 4. A relief or equivalent area 724 may be formed on or in the side of the forward portion 712 to provide an area for placement of the identification of the tool 710 or other data.

The rearward sight ring alignment portion 716 is also cylindrical. The rearward sight ring alignment portion 716 is precisely machined or otherwise formed to have a diameter D1 adapted to match closely with the diameter of certain telescopic sights, e.g., sights having an outer diameter of 30 millimeters or 1.181 inches. Thus, the outside diameter D1 of the sight ring alignment portion 716 will fit closely within corresponding telescopic sight mounting rings for such 30 millimeter diameter telescopic sights. However, it will be seen that the diameter of the sight ring alignment portion 716 may be adjusted to fit other telescopic sight diameters and their corresponding mounting rings.

Figure 8:
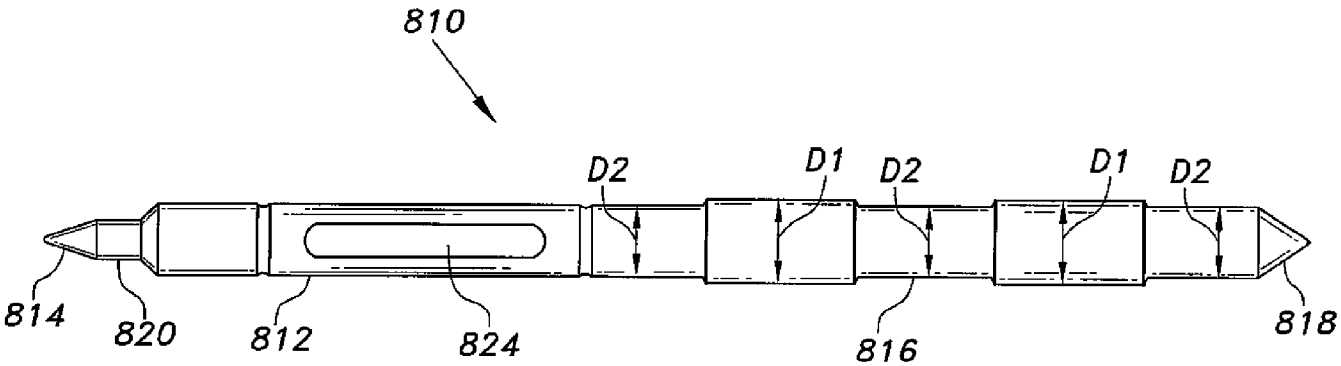
FIG. 8 is a left side elevation view of a fifth embodiment of a telescopic sight ring mounts alignment tool according to the present invention.

FIG. 8 of the drawings provides an illustration of a fifth embodiment of the telescopic sight ring mounts alignment tool, designated as tool 810. The tool 810 of FIG. 8 is also formed of a single, straight, unitary length of highly rigid material, such as metal bar stock or the like, e.g., tool steel, corrosion-resistant steel (i.e., "stainless" steel), or even brass or aluminum, to preclude any significant bending of the tool while in use. The tool 810 is also formed from a solid monolithic bar or rod that is devoid of interior hollows to make it completely rigid, for all practical purposes.

The tool 810 of FIG. 8 is similar to the tool 710 of FIG. 7, having a forward portion 812 having a forward tip 814 and an opposite rearward sight ring alignment portion 816 having a rearward tip 818. The forward and rearward tips 814 and 818 are conically tapered and concentric with the remainder of the tool 810. The forward tip 814 serves as a firearm barrel alignment indicator, and the rearward tip 818 provides for alignment of the tool with the receiver tang or other structure of the firearm in aligning the telescopic sight rings on a firearm, as described further above for the first three embodiments of FIGS. 1 through 6. A smaller diameter cylindrical portion 820 may be provided between the forward end of the constant diameter, cylindrical forward portion 812 and the conically tapered tip 814 to provide greater resolution when aligning the forward end of the tool with the firearm barrel.

The forward portion 812 has an arbitrary diameter, e.g., one inch. The forward portion 812 is used primarily for handling the tool 810 and for the extension of the forward firearm barrel alignment indicator tip 814, and does not need to fit closely with any other components or mechanisms. The forward portion 812 may include a textured gripping surface disposed thereover, generally as shown in the embodiments of FIGS. 9 and 10, or the circumferentially ribbed surface 26 of the first two embodiments illustrated in FIGS. 1 through 4. A relief or equivalent area 824 may be formed on or in the side of the forward portion 812 to provide an area for placement of the identification of the tool 810 or other data.

The rearward sight ring alignment portion 816 is also cylindrical, but the outer diameter of this portion 816 will be seen to vary along its length. The forward, rearward, and central portions of the sight ring alignment portion 816 have relatively smaller diameters D2, e.g., one inch in diameter, to fit closely within the corresponding inside diameter of telescopic sight rings for scopes having such an outer diameter D2. However, the sight ring alignment portion 816 also includes two larger diameter sections or portions D1 alternating with the three smaller diameter portions D2. The larger diameter portions serve the same purpose or function as the continuous larger diameter D1 of the telescopic sight ring mounts alignment tool 710 of FIG. 7, i.e., they fit closely within the corresponding inner diameters of telescopic sight rings adapted for larger diameter telescopic sights, e.g., 30 millimeter diameter sights. In this manner, the tool 810 may be used to align the sight rings for either diameter of telescopic sight, merely by moving the tool 810 forward or rearward to position the appropriate diameter D1 or D2 sections within the corresponding sight rings, as appropriate. Thus, a gunsmith or other person working with multiple firearms having different diameter telescopic sights and sight rings need only acquire a single sight ring alignment tool 810 to work with such varying diameter sights and their mounting rings.

FIG. 9 of the drawings provides an exploded perspective view of a sixth embodiment of the telescopic sight ring mounts alignment tool, designated as tool 910. The tool 910 of FIG. 9 is configured similarly to the tool embodiment 10 of FIG. 5. Both the forward portion 912 and the rearward portion 916 have a substantially constant smaller diameter D2 throughout the length of the tool. The tool 910 has a forward portion 912 and a forward tip 914, and an opposite rearward sight ring alignment portion 916 having a rearward tip 918. The forward and rearward tips 914 and 918 are conically tapered and concentric with the remainder of the tool 910 for the same purposes described further above for other embodiments. A smaller diameter cylindrical portion 920 may be provided between the forward end of the constant diameter, cylindrical forward portion 912 and the conically tapered tip 914. The knurled or otherwise textured surface 924 is shown on the forward portion 912 of the tool 910 to provide a better grip when handling the tool.

The telescopic sight ring mounts alignment tool 910 of FIG. 9 differs from other tools described herein in that it includes two adapter sleeves or bushings 926*a* and 926*b* to adapt the tool 910 for use with larger inside diameter telescopic sight mounting rings. Each of the sleeves 926*a* and 926*b* has an inner diameter D2 adapted to fit closely over the corresponding outer diameter D2 of the sight ring alignment portion 916, and an outer diameter D1 adapted to fit closely within the inner diameter of relatively larger telescopic sight mounting rings. In this manner, a gunsmith or other technician may use the tool 910 without the sleeves for aligning relatively smaller diameter sight rings, and slip the two rings 926*a* and 926*b* over the sight ring alignment portion 916 to use the tool 910 with larger internal diameter sight rings. It will be seen that the lengths of the rings 926*a* and 926*b* are not specified, and a single longer ring may be provided in lieu of the two shorter rings 926*a* and 926*b* to extend through both the front and rear sight mounting rings, if desired.

Nearly all telescopic sights have outer diameters of either one inch (25.4 millimeters) or 30 millimeters (1.181 inches), although other diameters are sometimes used. It will be noted that the difference between these two standard diameters is small, i.e., only 4.6 millimeters or 0.0905 inches. The wall thickness of the rings 926*a* and 926*b* are one-half of this difference, i.e., 2.3 millimeters or 0.04525 inches, or slightly less than 3/64 of an inch. Such thin material would be more susceptible to damage than thicker walled material. Accordingly, FIG. 10 provides an exploded perspective view of a seventh embodiment 1010 in response to this potential problem.

The telescopic sight ring mounts alignment tool 1010 of FIG. 10 is configured generally like the other tool embodiments of FIGS. 1 through 9 and described further above, having a forward portion 1012 and a forward tip 1014, an opposite rearward sight ring alignment portion 1016 having a rearward tip 1018, a smaller diameter cylindrical portion 1020 between the forward end of the constant diameter, cylindrical forward portion 1012 and the conically tapered tip 1014, and a knurled or otherwise textured area 1024 along the forward portion 1012. However, the diameter D3 of the sight ring alignment portion 1016 is somewhat smaller than the diameter D2 of the tool 910 of FIG. 9. As the outer diameters of the various adapter sleeves or bushings must still be sufficient to fit closely within the corresponding telescopic sight mounting rings, it will be seen that reducing the diameter of the sight ring alignment portion 1016 to an even smaller diameter D3 will result in a thicker wall thickness for both types of sleeves.

In the example of FIG. 10, the sight ring alignment portion 1016 may have a diameter D3 on the order of three-quarters of an inch (19.05 millimeters). This results in the larger diameter sleeves 1026*a* and 1026*b* having corresponding inner diameters D3 of three-quarters of an inch or 19.05 mm, and outer diameters D1 of 30 mm or 1.181 inches. This provides a wall thickness of 5.475 mm, or slightly more than 0.21 inch. The sleeves 1028*a* and 1028*b* also have inner diameters D3 of three-quarters of an inch or 19.04 mm, but have smaller outer diameters D2 of one inch or 25.4 mm. This results in a wall thickness of 1/8 inch or 3.175 mm, i.e., significantly greater than the relatively thin wall section of the adapter sleeves or rings 926*a* and 926*b* of the embodiment of FIG. 9, i.e., 2.3 millimeters or 0.04525 inches, slightly more than 1/32inch, the strengths of the sleeves 1026*a* and 1026*b* being increased accordingly. As in the case of the sleeves 926*a* and 926*b* of the embodiment of FIG. 9, a single longer sleeve may be provided in lieu of the two sleeves 1026*a* and 1026*b* or 1028*a* and 1028*b*, if desired.

It will be seen that the above dimensions are exemplary, and that the sight ring alignment portion 1016 of the tool 1010 may have any suitable diameter D3 that provides sufficient rigidity for the tool. The sleeves 1026*a* through 1028*b* have corresponding inner diameters D3. The outer diameters D1 and D2 are also exemplary, and have been specified further above in order to fit closely with telescopic sight mounting rings adapted for the vast majority of telescopic sights. However, it will be seen that these dimensions may be adjusted to fit any practicable mounting ring diameter, as needed.

The various embodiments of the telescopic sight ring mounts alignment tool described herein are used substantially as described further above for the first three embodiments. Some variation in the order of the steps involved may depend upon the specific type of ring sight mount. The common theme that extends through the operation and use of all of the tool embodiments is that they not only serve to align the front and rear telescopic sight mounting rings with one another, but the unitary, monolithic, rigid nature of the tool also provides for the alignment of the sight rings with the longitudinal axis of the barrel of the firearm. This assures that the centermost areas of the telescopic sight lenses are used to sight a target with corresponding accuracy due to the avoidance of the increased refraction that occurs toward the edges of any curved lens. This also assures that elevation and windage adjustment for the sight reticle is closely centered to permit maximum adjustment throughout the horizontal and vertical axes, as needed. The result is increased accuracy for the marksman and his or her firearm, accomplished in a single setup and adjustment procedure using the telescopic sight ring mounts alignment tool.

It is to be understood that the present invention is not limited to the embodiments described above, but encompasses any and all embodiments within the scope of the following claims.

I claim:

1. A telescopic sight ring mounts alignment tool, comprising:

a rigid, monolithic, unitary, elongate solid metal bar having a forward end and a rearward end opposite the forward end;

a conically tapered firearm barrel alignment indicator extending from the forward end;

a conically tapered receiver tang alignment indicator extending from the rearward end, wherein the conically tapered receiver tang alignment indicator is axially concentric with and distinctly configured from the conically tapered firearm barrel alignment indicator; and a sight ring alignment portion extending from the rearward end toward the forward end, the sight ring alignment portion having a length and an outer diameter dimensioned and configured to fit within a forward and rearward telescopic sight rings of a firearm, wherein the length of the sight ring alignment portion extending beyond the forward sight ring is substantially greater than the length between the forward and rearward telescopic sight rings so as to overlie a barrel of the firearm.

2. The telescopic sight ring mounts alignment tool according to claim 1, further comprising a plurality of first and second diameter sight ring alignment portions extending forward from the rearward end, the first and second diameter sight ring alignment portions alternating with one another and having outer diameters adapted to fit closely within corresponding telescopic sight rings of a firearm.

3. The telescopic sight ring mounts alignment tool according to claim 1, further comprising at least one pair of adapter sleeves removably disposed upon the sight ring alignment portion, the adapter sleeves having inner diameters fitting closely about the sight ring alignment portion and outer diameters dimensioned and configured to fit closely within the telescopic sight rings of a firearm.

4. The telescopic sight ring mounts alignment tool according to claim 3, further comprising:

a first pair of adapter sleeves having outer diameters adapted to fit closely within a first telescopic sight ring inner diameter; and a second pair of adapter sleeves having outer diameters adapted to fit closely within a second telescopic sight ring inner diameter.

5. The telescopic sight ring mounts alignment tool according to claim 1, wherein the firearm barrel alignment indicator is removably attached to the forward end of the bar.

6. The telescopic sight ring mounts alignment tool according to claim 1, further comprising a textured gripping portion disposed between the sight ring alignment portion and the forward end of the bar.

7. The telescopic sight ring mounts alignment tool according to claim 1, wherein the firearm barrel alignment indicator further includes a small diameter cylindrical portion disposed between the forward end of the bar and the conically tapered tip of the indicator.

8. The telescopic sight ring mounts alignment tool according to claim 1, wherein the bar is formed of metal selected from the group consisting of tool steel, stainless steel, brass, and aluminum.

9. In combination, a telescopic sight ring mounts alignment tool and a pair of telescopic sight mounting rings, comprising:

a pair of telescopic sight mounting rings, the telescopic rings including at least a front ring and a rear ring;

a rigid, monolithic, unitary, elongate solid metal bar having a forward end and a rearward end opposite the forward end;

a conically tapered firearm barrel alignment indicator extending from the forward end;

a conically tapered receiver tang alignment indicator extending from the rearward end, wherein the conically tapered receiver tang alignment indicator is axially concentric with and distinctly configured from the conically tapered firearm barrel alignment indicator; and a sight ring alignment portion extending from the rearward end toward the forward end, the sight ring alignment portion having a length and an outer diameter dimensioned and configured to fit within the front and rear telescopic sight mounting rings of a firearm, wherein the length of the sight ring alignment portion extending beyond the front telescopic sight mounting ring is substantially greater than the length between the front and rear telescopic sight mounting rings so as to overlie a barrel of the firearm.

* * * * *